US005380644A

United States Patent [19]

Yonkoski et al.

[11] Patent Number: 5,380,644

[45] Date of Patent: Jan. 10, 1995

[54] ADDITIVE FOR THE REDUCTION OF MOTTLE IN PHOTOTHERMOGRAPHIC AND THERMOGRAPHIC ELEMENTS

[75] Inventors: Roger K. Yonkoski, Woodbury; Patricia M. Savu, Maplewood, both of Minn.

[73] Assignee: Minnesota Mining and Manufacturing Company, St. Paul, Minn.

[21] Appl. No.: 104,888

[22] Filed: Aug. 10, 1993

[51] Int. Cl.[6] ..... G03C 1/494

[52] U.S. Cl. ..... 430/617; 430/619; 430/631; 430/634; 430/638; 430/637

[58] Field of Search ..... 430/617, 619, 631, 634, 430/638, 637

[56] References Cited

U.S. PATENT DOCUMENTS

| | | | |
|---|---|---|---|
| 3,180,731 | 4/1965 | Roman et al. | 96/29 |
| 3,457,075 | 7/1969 | Morgan et al. | 96/67 |
| 3,531,286 | 9/1970 | Renfrow | 96/67 |
| 3,573,916 | 4/1971 | Yost | 96/74 |
| 3,761,270 | 9/1973 | deMauriac et al. | 96/77 |
| 3,839,049 | 10/1974 | Simons | 96/114.6 |
| 3,846,136 | 11/1974 | Sullivan | 96/114.1 |
| 3,950,298 | 4/1976 | McCown et al. | 260/33.6 F |
| 3,994,732 | 11/1976 | Winslow | 96/114.1 |
| 4,021,240 | 5/1977 | Cerquone et al. | 96/29 D |
| 4,021,249 | 5/1977 | Noguchi et al. | 96/114.1 |
| 4,022,617 | 5/1977 | McGuckin | 96/29 D |
| 4,051,278 | 9/1977 | Democh | 427/326 |
| 4,187,108 | 2/1980 | Willis | 430/203 |
| 4,260,677 | 4/1981 | Winslow et al. | 430/618 |
| 4,374,921 | 2/1983 | Frenchik | 430/338 |
| 4,426,441 | 1/1984 | Adin et al. | 430/351 |
| 4,450,681 | 5/1984 | Sato et al. | 60/286 |
| 4,460,681 | 7/1984 | Frenchik | 430/502 |
| 4,557,837 | 12/1985 | Clark, III et al. | 252/8.55 C |
| 4,764,450 | 8/1988 | Ruckert et al. | 430/191 |
| 4,853,314 | 8/1989 | Ruckert et al. | 430/191 |
| 4,883,747 | 11/1989 | Grieve et al. | 430/542 |
| 4,891,307 | 1/1990 | Mukunoki et al. | 430/631 |
| 4,999,927 | 3/1991 | Durst et al. | 34/23 |

*Primary Examiner*—Thorl Chea

*Attorney, Agent, or Firm*—Gary L. Griswold; Walter N. Kirn; Gregory A. Evearitt

[57] ABSTRACT

A fluorinated polymer comprising at least three different groups within the polymer chain derived from reactive monomers, the monomers comprising:

(a) a fluorinated, ethylenically unsaturated monomer;

(b) a hydroxyl-containing, ethylenically unsaturated monomer; and (c) a polar, ethylenically unsaturated monomer.

The fluorinated polymers provide a surfactant that is particularly useful in the coating of polymeric layers. The surfactants can reduce surface anomalies, such as mottle when used to coat photothermographic and thermographic elements from certain solvent systems. The present invention also provides photothermographic and thermographic elements comprising the foregoing fluorinated polymers.

19 Claims, No Drawings

ADDITIVE FOR THE REDUCTION OF MOTTLE IN PHOTOTHERMOGRAPHIC AND THERMOGRAPHIC ELEMENTS

BACKGROUND OF THE INVENTION

1. Field of the Invention

The present invention relates to novel fluorochemical surfactants and in particular, it relates to the use of novel fluorochemical surfactants in photothermographic and thermographic elements. The use of fluorochemical surfactants in coating compositions reduces disuniformities, such as mottle, in photothermographic elements.

2. Background of the Art

Silver halide-containing photothermographic imaging materials (i.e., heat-developable photographic materials) processed with heat, and without liquid development, have been known in the art for many years. These materials, also known as "dry silver" compositions or emulsions, generally comprise a support having coated thereon: (1) a photosensitive material that generates elemental silver when irradiated; (2) a non-photosensitive, reducible silver source; (3) a reducing agent for the non-photosensitive, reducible silver source; and (4) a binder. The photosensitive material is generally photographic silver halide which must be in catalytic proximity to the non-photosensitive, reducible silver source. Catalytic proximity requires an intimate physical association of these two materials so that when silver specks or nuclei are generated by the irradiation or light exposure of the photographic silver halide, those nuclei are able to catalyze the reduction of the non-photosensitive, reducible silver source. It has long been understood that elemental silver (Ag°) is a catalyst for the reduction of silver ions, and the photo-sensitive, photographic silver halide may be placed into catalytic proximity with the non-photosensitive, reducible silver source in a number of different fashions, such as by partial metathesis of the reducible silver source with a halogen-containing source (see, for example, U.S. Pat. No. 3,457,075); co-precipitation of silver halide and reducible silver source material (see, for example, U.S. Pat. No. 3,839,049); and other methods that intimately associate the photosensitive, photographic silver halide and the non-photosensitive, reducible silver source.

The non-photosensitive, reducible silver source is a material that contains silver ions. The preferred non-photosensitive, reducible silver source comprises silver salts of long chain aliphatic carboxylic acids, typically having from 10 to 30 carbon atoms. The silver salt of behenic acid or mixtures of acids of similar molecular weight are generally used. Salts of other organic acids or other organic materials, such as silver imidazolates, have been proposed and U.S. Pat. No. 4,260,677 discloses the use of complexes of inorganic or organic silver salts as non-photosensitive, reducible silver sources.

In both photographic and photothermographic emulsions, exposure of the photographic silver halide to light produces small clusters of silver atoms (Ag°). The imagewise distribution of these clusters is known in the art as a latent image. This latent image generally is not visible by ordinary means and the photosensitive emulsion must be further processed in order to produce a visible image. The visible image is produced by the reduction of silver ions, which are in catalytic proximity to silver halide grains bearing the clusters of silver atoms, i.e. the latent image. This produces a black and white image.

As the visible image is produced entirely by elemental silver (Ag°), one cannot readily decrease the amount of silver in the emulsion without reducing the maximum image density. However, reduction of the amount of silver is often desirable in order to reduce the cost of raw materials used in the emulsion.

One method of attempting to increase the maximum image density in black-and-white photographic and photothermographic emulsions without increasing the amount of silver in the emulsion layer is by incorporating toning agents into the emulsion. Toning agents improve the color of the silver image of the photothermographic emulsions, as described in U.S. Pat. Nos. 3,846,136; 3,994,732; and 4,021,249.

Another method of increasing the maximum image density of photographic and photothermographic emulsions without increasing the amount of silver in the emulsion layer is by incorporating dye-forming materials in the emulsion. For example, color images can be formed by incorporation of leuco dyes into the emulsion. Leuco dyes are the reduced form of a color-bearing dye. Upon imaging, the leuco dye is oxidized, and the color-bearing dye and a reduced silver image are simultaneously formed in the exposed region. In this manner, a dye enhanced silver image can be produced, as shown, for example, in U.S. Pat. Nos. 3,531,286; 4,187,108; 4,426,441; 4,374,921; and 4,460,681.

Multicolor photothermographic imaging articles typically comprise two or more monocolor-forming emulsion layers (often each emulsion layer comprises a set of bilayers containing the color-forming reactants) maintained distinct from each other by barrier layers. The barrier layer overlaying one photosensitive, photothermographic emulsion layer typically is insoluble in the solvent of the next photosensitive, photothermographic emulsion layer. Photothermographic articles having at least 2 or 3 distinct color-forming emulsion layers are disclosed in U.S. Pat. Nos. 4,021,240 and 4,460,681. Various methods to produce dye images and multicolor images with photographic color couplers and leuco dyes are well known in the art as represented by U.S. Pat. Nos. 4,022,617; 3,531,286; 3,180,731; 3,761,270; 4,460,681; 4,883,747; and *Research Disclosure,* March 1989, item 29963.

Thermographic imaging constructions (i.e., heat-developable materials) processed with heat, and without liquid development, are widely known in the imaging arts and rely on the use of heat to help produce an image. Upon heating, typically in the range of about 60°–225° C., a reaction occurs only in the heated areas, resulting in the formation of an image.

Thermographic elements whose image-forming layers are based on silver salts of long chain fatty acids, such as silver behenate, are also known. These elements generally comprise a support or substrate (such as paper, plastics, metals, glass, and the like) having coated thereon: (1) a thermally sensitive reducible silver source; (2) a reducing agent for the thermally sensitive reducible silver source; and (3) a binder. Upon heating, silver behenate is reduced by a reducing agent for silver ion such as methyl gallate, hydroquinone, substituted-hydroquinones, hindered phenols, catechol, pyrogallol, ascorbic acid, ascorbic acid derivatives, leuco dyes, and the like, whereby an image comprised of elemental silver is formed.

Photothermographic and thermographic constructions are usually prepared by coating from solution and removing most of the coating solvent by drying. One common problem that exists with coating photothermographic systems is the formation of coating defects. Many of the defects and problems that occur in the final product can be attributed to phenomena that occur in the coating and drying procedures. Among the problems that are known to occur during drying of polymeric film layers after coating is unevenness in the distribution of solid materials within the layer. Examples of specific types of coating defects encountered are "orange peel", "mottling", and "fisheyes". "Orange peel" is a fairly regular grainy surface that occurs on a dried, coated film, usually because of the action of the solvent on the materials in the coating composition. "Mottling" often occurs because of an unevenness in the removal of the solvent from the coating composition. Fisheyes are another type of coating problem, usually resulting from a separation of components during drying. There are pockets of different ingredients within the drying solution, and these pockets dry out into uneven coating anomalies.

Surfactants have often been used to correct these types of problems, along with changes in the solvents of the coating compositions. In some cases, surfactants do not correct the problem, and in other cases the surfactants create other problems even when they cure the first problem. It is sometimes necessary to investigate a large number of commercially available surfactants before finding one that is appropriate for a particular type of system, even if that commercial product is touted for use in correcting a particular type of defect.

For a surfactant to be useful in an imaging element is must have several properties. It must be soluble in the coating solution or emulsion. If it were not, then other defects such as fish-eyes and streaks may occur in the dried coating The surfactant must not stabilize foams or air bubbles within the coating solution or emulsion as these cause streaks in the dried coating. These defects are readily visible and are unacceptable in a final element. Additionally, the surfactant cannot significantly alter the sensitometric properties of the imaging element such as speed, contrast, minimum density, and maximum density.

Fluorochemical surfactants are useful in coating applications to reduce mottle. When a coating solution is dried at high speeds in an industrial oven, the resulting film often contains a mottle pattern. This mottle pattern is often the result of surface tension gradients created by non-uniform drying conditions. When an appropriate fluorochemical surfactant is added to the coating solution, the surfactant holds the surface tension at a lower, but constant value. This results in a uniform film, free from mottle. Fluorochemical surfactants are used because organic solvents, such as 2-butanone (also known as methyl ethyl ketone or MEK), already have such low surface energies (24.9 dynecm) that hydrocarbon surfactants are ineffective.

Allowed copending U.S. patent application Ser. No. 07/966,458 describes the use of fluorochemical surfactants to reduce coating disuniformities such as mottle, fisheye, and foaming in positive-acting or negative-acting resist systems such as printing plates and other non-resist imageable polymerizable systems. These polymers are comprise a fluorochemical acrylate, a short-chain-alkyl acrylate, and a polar monomer. Use of these materials in photothermographic or thermographic elements is not discussed.

U.S. Pat. Nos. 4,764,450 and 4,853,314 describe the use of particular changes in solvent systems to improve surface defects in positive-acting photoresist imaging systems.

U.S. Pat. No. 4,557,837 describes fluorochemicals useful in the preparation of foamable compositions such as those used in the cleanup of gas wells. Polymers described include copolymers of fluorochemical monomers and hydroxyethylacrylate, and copolymers of fluorochemical monomers, acrylic acid, and short chain acrylates.

JP 01-223,168 describes fluorinated terpolymers that are useful additives to varnish formulations. They improve the stain resistance of the varnish.

JP 57-040579 describes fluorinated terpolymers which are useful as release coatings for adhesive tapes.

U.S. Pat. No. 3,950,298 describes thermoplastic fluorinated terpolymers that are useful, non-foaming additives to coating solutions for polymeric materials such as carpets and fibers. The coating compositions provide oleophobicity to the surfaces that are coated.

U.S. Pat. No. 4,051,278 describes a process where a foraminous shield (such as a screen or perforated plate) is used to protect the coated web from the impingement air used for dying. Both solvent-rich and solvent-poor air can flow through the shield. Air velocity and turbulence are reduced by the porous shield. Although this method is claimed to reduce the degree of mottle, the amount and presence of mottle was still influenced by increased flow rate of the impingement air.

U.S. Pat. No. 4,999,927 describes an oven system for which the air flow boundary layer along the web remains laminar. This is accomplished by accelerating the air through the drying chamber.

U.S. Pat. No. 4,894,927 describes a technique for reducing mottle by combining an inert gas system with a small drying chamber. Using this method, the air flow remains laminar over the web.

U.S. Pat. No. 3,573,916 describes the use of sulfo-substituted cyanine dyes to reduce mottle in color-bearing silver halide emulsions which have been coated on electron bombarded hydrophobic surfaces.

SUMMARY OF THE INVENTION

The present invention describes a fluorinated polymer having at least three different groups within the polymer chain derived from reactive monomers, the monomers comprising:

a) a fluorinated, ethylenically unsaturated monomer,
b) a hydroxyl-containing, ethylenically unsaturated monomer, and
c) a polar, ethylenically unsaturated monomer.

Fluorinated terpolymers formed by the polymerization of the above mentioned monomers can provide a non-foaming or low foaming surfactant that is particularly useful in the application of polymeric layers. The surfactants can reduce surface anomalies such as mottle when used in certain solvent systems.

In another embodiment, the present invention provides photothermographic elements coated on a substrate wherein the photothermographic composition comprises:

(a) a photosensitive silver halide;
(b) a non-photosensitive, reducible source of silver;
(c) a reducing agent for the non-photosensitive, reducible source of silver;

(d) a binder; and (e) a fluorinated polymer comprising at least three different groups within the polymer chain derived from reactive monomers, the groups comprising:

(i) a fluorinated, ethylenically unsaturated monomer;

(ii) a hydroxyl-containing, ethylenically unsaturated monomer; and (iii) a polar, ethylenically unsaturated monomer.

In a further embodiment, the present invention provides thermographic elements comprising a substrate coated with a thermographic composition comprising:

(a) a non-photosensitive, reducible source of silver;

(b) a reducing agent for the non-photosensitive, reducible source of silver;

(c) a binder; and (d) a fluorinated polymer comprising at least three different groups within the polymer chain derived from reactive monomers, the groups comprising:

(i) a fluorinated, ethylenically unsaturated monomer;

(ii) a hydroxyl-containing, ethylenically unsaturated monomer; and (iii) a polar, ethylenically unsaturated monomer.

The reducing agent for the non-photosensitive reducible silver source may optionally comprise a compound capable of being oxidized to form or release a dye. Preferably, the dye-forming material is a leuco dye.

The polymers of the present invention are effective in reducing or eliminating coating defects, such as mottle, when photothermographic and thermographic emulsions are coated from polar organic solvents such as ketones or alcohols. These compounds are added in minute quantities without significantly or adversely affecting the imaging or sensitometric properties of the photothermographic material.

As used herein, the term "emulsion layer" means a layer of a photothermographic element that contains a photosensitive silver salt and non-photosensitive, reducible silver source material; or a layer of a thermographic element that contains a non-photosensitive, reducible silver source material.

As is well understood in this technical area, a large degree of substitution is not only tolerated, but is also often advisable and substitution is anticipated on the compounds of the present invention. As a means of simplifying the description of substituent groups, the terms "group" (or "nucleus") and "moiety" are used to differentiate between those chemical species that may be substituted and those which may not be so substituted. Thus, when the term "group", "aryl group", or "central nucleus" is used to describe a substituent, that substituent includes the use of additional substituents beyond the literal definition of the basic group. Where the term "moiety" is used to describe a substituent, only the unsubstituted group is intended to be included. For example, the phrase, "alkyl group" is intended to include not only pure hydrocarbon alkyl chains, such as methyl, ethyl, propyl, t-butyl, cyclohexyl, iso-octyl, octadecyl and the like, but also alkyl chains bearing substituents known in the art, such as hydroxyl, alkoxy, phenyl, halo (F, Cl, Br, and I), cyano, nitro, amino, carboxyl, etc, and heteroatoms such as O, N, and S. For example, alkyl group includes carboxyalkyls, hydroxyalkyls, ether groups (e.g., $CH_3—CH_2—CH_2—O—CH_2—$), haloalkyls, nitroalkyls, sulfoalkyls, etc. On the other hand, the phrase "alkyl moiety" is limited to the inclusion of only pure hydrocarbon alkyl chains, such as methyl, ethyl, propyl, t-butyl, cyclohexyl, iso-octyl, octadecyl, and the like. Substituents which react with active ingredients, such as very strong electrophilic or oxidizing substituents, would, of course, be excluded by the ordinary skilled artisan as not being inert or harmless.

Other aspects, advantages, and benefits of the present invention are apparent from the detailed description, examples, and claims.

DETAILED DESCRIPTION OF THE INVENTION

The novel polymeric surfactants of the present invention are particularly useful in the manufacture of polymer coatings, most particularly in the manufacture of photothermographic and thermographic elements where surface anomalies must be kept to a minimum. The fluorinated polymers contain at least three different groups and are derived from three different copolymerized monomers. The three monomers comprise a fluorinated, ethylenically unsaturated monomer; a hydroxyl-containing, ethylenically unsaturated monomer; and a polar, ethylenically unsaturated monomer.

The polymers can be conveniently prepared, thereby generating a polymeric backbone with the required pendant functionalities thereon. This can be done conveniently by selecting appropriate ethylenically unsaturated monomers with the desired pendant functionalities already present on the monomers so that they are also deposited on the polymer backbone. This is preferably done by forming an acrylate backbone by polymerization of at least three materials. Although acrylates are not the only materials that will work, they are preferred for the backbone.

The polymers are prepared by free-radical polymerization of the three monomers in the proportions desired for the final product. It is preferred that the monomers be present in the polymer as follows: about 10–35 mole % fluorinated, ethylenically unsaturated monomer; about 30–60 mole % hydroxyl-containing, ethylenically unsaturated monomer; and about 20–60 mole % polar, ethylenically unsaturated monomer; and more preferably, 27, 39, and 34 mole %, respectively, of the three monomers. The polymerization is carried out in solvents such as ethyl acetate, 2-butanone, ethanol, 2-propanol, acetone, etc.

In its simplest form, the fluorinated, ethylenically unsaturated monomer contains a fluorocarbon group bonded to an ethylenically unsaturated group. Alternatively, and preferably, the fluorocarbon group is bonded to a hydrocarbon portion which in turn is bonded to an ethylenically unsaturated group. The fluorochemical group may be directly bonded to the hydrocarbon group or it may be bonded through a bridging group such as a sulfonamido group. The preferred ethylenically unsaturated portion of the monomer is an acrylate group or a methacrylate group The preferred bridging group is a sulfonamido group.

Representative fluorinated, ethylenically unsaturated monomers are as follows:

$C_8F_{17}CH_2CH_2N(CH_3)COCH{=}CH_2$, $C_8F_{17}CH_2CH_2OCOCH{=}CH_2$, $C_6F_{13}C_2H_4SCOCH{=}CH_2$, $C_8F_{17}SO_2N(C_2H_5)C_2H_4NHCOCH{=}CH_2$, $(CF_3)_2CF(CF_2)_8C_2H_2SCOC(CH_3){=}CH_2$, $C_8F_{17}SO_2N(CH_3)C_2H_4COOCH{=}CH_2$, $C_8F_{17}SO_2N(CH_3)CH_2C_6H_4CH{=}CH_2$, $C_6F_{13}CH_2CH_2OOCC({=}CH_2)COOCH_2CH_2C_6F_{13}$, $C_7F_{15}CH_2OOCCH{=}CHCOOCH_2C_7F_{15}$,
$C_6F_{13}C_2H_4N(CH_2CH_2OH)COCH{=}CH_2$,
$C_7F_{15}CON(C_2H_5)C_3H_6SCOC(CH_3){=}CH_2$,
$C_6F_{13}CH_2NHCOCH{=}CH_2$,
$C_8F_{17}CH_2CH_2OCH{=}CH_2$,
$(CF_3)_2CF(CF_2)_6CH_2CH(OH)CH_2COCH{=}CH_2$,
$(CH_3)_2CFOC_2F_4OCOCH{=}CH_2$,
$C_8F_{17}C_2H_4SO_2N(C_3H_7)C_2H_4OCOCH{=}CH_2$,
$C_7F_{15}C_2H_4CONHC_4H_8OCOCH{=}CH_2$

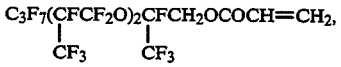

$C_7F_{15}COOCH_2C(CH_3)_2CH_2OCOC(CH_3){=}CH_2$,
$C_8F_{17}SO_2N(C_2H_5)C_4H_8OCOCH{=}CH_2$,
$(C_3F_7)_2C_6H_3SO_2N(CH_3)C_2H_4OCOCH{=}CH_2$,
$C_8F_{17}CF{=}CHCH_2N(CH_3)C_2H_4OCOCH{=}CH_2$,

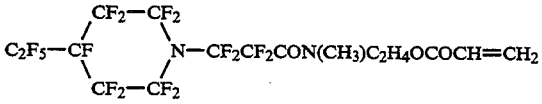

and combinations thereof. Preferred fluorinated, ethylenically unsaturated monomers are perfluoroaliphaticsulfonylamido acrylates and combinations thereof. Representative perfluoroaliphaticsulfonylamido acrylates include:
$C_8F_{17}SO_2N(C_2H_5)C_2H_4NHCOCH{=}CH_2$,
$C_8F_{17}SO_2N(CH_3)C_2H_4COOCH{=}CH_2$,
$C_8F_{17}SO_2N(CH_3)CH_2C_6H_4CH{=}CH_2$,
$C_8F_{17}C_2H_4SO_2N(C_3H_7)C_2H_4OCOCH{=}CH_2$,
$C_8F_{17}SO_2N(C_2H_5)C_4H_8OCOCH{=}CH_2$, and
$(C_3F_7)_2C_6H_3SO_2N(CH_3)C_2H_4OCOCH{=}CH_2$.

The hydroxyl-containing, ethylenically unsaturated monomer must have a polymerizable group compatible with acrylic polymerization and a pendant hydroxyl group. Preferred hydroxyl-containing, ethylenically unsaturated monomers are acrylate monomers such as hydroxyethylmethacrylate (HEMA), hydroxyethylacrylate (HEA), hydroxylpropylmethacrylate, and hydroxylpropylacrylate.

The polar, ethylenically unsaturated monomer for use in the present invention must have a polymerizable group compatible with acrylic polymerization, i.e., have ethylenic unsaturation as would be the case in an acidic styrene derivative. Representative ethylenically unsaturated polar monomers useful in such preparation include:
$CH_2{=}CHP(O)(OH)_2$,
$CH_2{=}CHCOOH$,
$CH_2{=}C(CH_3)COOH$,
$HOOCC({=}CH_2)CH_2COOH$,
$CH_2{=}CHSO_3H$,
$CH_2{=}CHCH_2SO_3H$,
$CH_2{=}CHCONHC(CH_3)_2CH_2SO_3H$,
$(CH_3)_2NCH_2CH_2OCOC(CH_3){=}CH_2$,
$(CH_3)_2NCH_2CH_2OCOCH{=}CH_2$,
and combinations thereof. Preferred polar monomers are acidic monomers of acrylates (including methacrylates) and particularly those at least as polar, and preferably more polar, than hydroxyethylmethacrylate (HEMA).

Preferred fluorinated polymers have weight average molecular weights in the range of about 2,000 to 20,000. Most preferred fluorinated polymers have weight average molecular weights of from 2,000 to 7,000.

The polymers useful in the present invention comprise any polymer soluble or dispersible in the organic solvent, particularly 2-butanone (also known as methyl ethyl ketone or MEK), ethanol, and 90/10 mixtures of 2-butanone and ethanol.

In order to test the image uniformity of the film, it must be exposed to a uniform light intensity pattern and then uniformly heat processed. At this point, the film can be inspected for spatial variation in the image density.

The fluorochemical surfactants of the present invention reduce coating defects in photothermographic elements without causing other deleterious side-effects in the coating or in the imaging properties of the photothermographic element.

In another embodiment, the present invention provides a photothermographic element comprising a substrate coated with a photothermographic composition comprising:

(a) a photosensitive silver halide;
(b) a non-photosensitive, reducible source of silver;
(c) a reducing agent for the non-photosensitive, reducible source of silver;
(d) a binder; and
(e) a fluorinated polymer comprising at least three different groups within the polymer chain derived from reactive monomers, the monomers comprising:
  (i) a fluorinated, ethylenically unsaturated monomer;
  (ii) a hydroxyl-containing, ethylenically unsaturated monomer; and
  (iii) a polar, ethylenically unsaturated monomer.

In photothermographic articles of the present invention, the layer(s) that contain the photosensitive silver halide and non-photosensitive, reducible source material are referred to herein as emulsion layer(s).

In a further embodiment, the present invention provides a thermographic element comprising a substrate coated with a thermographic composition comprising:

(a) a non-photosensitive, reducible source of silver;
(b) a reducing agent for the non-photosensitive, reducible source of silver;
(c) a binder; and
(d) a fluorinated polymer comprising at least three different groups within the polymer chain derived from reactive monomers, the monomers comprising:
  (i) a fluorinated, ethylenically unsaturated monomer;
  (ii) a hydroxyl-containing, ethylenically unsaturated monomer; and
  (iii) a polar, ethylenically unsaturated monomer.

In thermographic articles of the present invention, the layer(s) that contain the non-photosensitive, silver source material are referred to herein as emulsion layer(s).

According to the present invention, the fluorinated polymer is preferably added to a layer or layers adjacent to one or more emulsion layers. Layers that are adjacent to emulsion layers may be, for example, primer layers, image-receiving layers, interlayers, opacifying layers, antihalation layers, barrier layers, auxiliary layers, etc.

Photothermographic and thermographic articles of the present invention may contain other additives in combination with the fluorinated surfactant compounds of the invention, as well as other additives, such as shelf-life stabilizers, toners, development accelerators, and other image-modifying agents.

The amounts of the above-described ingredients that are added to the emulsion layer or top-coat layer according to the present invention may be varied depending upon the particular compound used and upon the type of emulsion layer (i.e., black-and-white or color). However, the amount of fluorinated polymer is preferably added to a top-coat layer in an amount of 0.05% to 10%, and more preferably from 0.1% to 1%, by weight of the layer.

The Photosensitive Silver Halide

The photosensitive silver halide can be any photosensitive silver halide, such as silver bromide, silver iodide, silver chloride, silver bromoiodide, silver chlorobromoiodide, silver chlorobromide, etc. The photosensitive silver halide can be added to the emulsion layer in any fashion so long as it is placed in catalytic proximity to the organic silver compound which serves as a source of reducible silver.

The light sensitive silver halide used in the present invention can be employed in a range of 0.005 mol to 0.5 mol and, preferably from 0.01 mol to 0.15 mol per mole, of silver salt. The silver halide may be added to the emulsion layer in any manner which places it in catalytic proximity to the silver source.

The silver halide used in the present invention may be employed without modification. However, it can be chemically and spectrally sensitized in a manner similar to that used to sensitize conventional wet process silver halide or state-of-the-art heat-developable photographic materials. For example, it may be chemically sensitized with a chemical sensitizing agent such as a compound containing sulfur, selenium or tellurium etc., or a compound containing gold, platinum, palladium, ruthenium, rhodium or iridium, etc., a reducing agent such as a tin halide, etc., or a combination thereof. The details of these procedures are described in T. H. James *The Theory of the Photographic Process*, Fourth Edition, Chapter 5, pages 149 to 169. Suitable chemical sensitization procedures are also described in Shepard, U.S. Pat. No. 1,623,499; Waller, U.S. Pat. No. 2,399,083; McVeigh, U.S. Pat. No. 3,297,447; and Dunn, U.S. Pat. No. 3,297,446.

The light-sensitive silver halides may be spectrally sensitized with various known dyes that spectrally sensitizes silver halide. Non-limiting examples of sensitizing dyes that can be employed include cyanine dyes merocyanine dyes, complex cyanine dyes, complex merocyanine dyes, holopolar cyanine dyes, hemicyanine dyes, styryl dyes, and hemioxanol dyes. Of these dyes, cyanine dyes, merocyanine dyes, and complex merocyanine dyes are particularly useful.

An appropriate amount of sensitizing dye added is generally in the range of from about $10^{-10}$ to $10^{-1}$ mole, and preferably from about $10^{-10}$ to $10^{-3}$ moles per mole of silver halide.

The Non-Photosensitive Reducible Silver Source Material

The non-photosensitive, reducible silver source can be any material that contains a source of reducible silver ions. Silver salts of organic acids, particularly silver salts of long chain fatty carboxylic acids, are preferred. The chains typically contain 10 to 30, preferably 15 to 28 carbon atoms. Complexes of organic or inorganic silver salts, wherein the ligand has a gross stability constant for silver ion of between 4.0 and 10.0, are also useful in this invention. The source of reducible silver material generally constitutes from 20 to 70% by weight of the emulsion layer. It is preferably present at a level of 30 to 55% by weight of the emulsion layer.

The organic silver salt which can be used in the present invention is a silver salt which is comparatively stable to light, but forms a silver image when heated to 80° C. or higher in the presence of an exposed photocatalyst (such as silver halide) and a reducing agent.

Suitable organic silver salts include silver salts of organic compounds having a carboxyl group. Preferred examples thereof include a silver salt of an aliphatic carboxylic acid and a silver salt of an aromatic carboxylic acid. Preferred examples of the silver salts of aliphatic carboxylic acids include silver behenate, silver stearate, silver oleate, silver laureate, silver caprate, silver myristate, silver palmitate, silver maleate, silver fumarate, silver tartarate, silver linoleate, silver butyrate and silver camphorate, mixtures thereof, etc. Silver salts which are substitutable with a halogen atom or a hydroxyl group can also be effectively used. Preferred examples of the silver salts of aromatic carboxylic acid and other carboxyl group-containing compounds include silver benzoate, a silver-substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc., silver gallate, silver tannate, silver phthalate, silver terephthalate, silver salicylate, silver phenylacetate, silver pyromellilate, a silver salt of 3-carboxymethyl-4-methyl-4-thiazoline-2-thione or the like as described in U.S. Pat. No. 3,785,830, and silver salt of an aliphatic carboxylic acid containing a thioether group as described in U.S. Pat. No. 3,330,663.

Silver salts of compounds containing mercapto or thione groups and derivatives thereof can be used. Preferred examples of these compounds include a silver salt of 3-mercapto-4-phenyl- 1,2,4-triazole, a silver salt of 2-mercaptobenzimidazole, a silver salt of 2-mercapto-5-aminothiadiazole, a silver salt of 2-(2-ethylglycolamido)benzothiazole, a silver salt of thioglycolic acid such as a silver salt of a S-alkylthioglycolic acid (wherein the alkyl group has from 12 to 22 carbon atoms) as described in Japanese patent application No. 28221/73, a silver salt of a dithiocarboxylic acid such as a silver salt of dithioacetic acid, a silver salt of thioamide, a silver salt of 5-carboxylic-l-methyl-2-phenyl-4-thiopyridine, a silver salt of mercaptotriazine, a silver salt of 2-mercaptobenzoxazole, a silver salt as described in U.S. Pat. No. 4,123,274, for example, a silver salt of 1,2,4-mercaptothiazole derivative such as a silver salt of 3-amino-5-benzylthio-1,2,4-thiazole, a silver salt of a thione compound such as a silver salt of 3-(2-carboxyethyl)-4-methyl-4-thiazoline-2-thione as disclosed in U.S. Pat. No. 3,201,678.

Furthermore, a silver salt of a compound containing an imino group can be used. Preferred examples of these compounds include a silver salt of benzothiazole and a derivative thereof as described in Japanese patent publication Nos. 30270/69 and 18146/70, for example, a silver salt of benzothiazole such as silver salt of methylbenzotriazole, etc., a silver salt of a halogen substituted benzotriazole, such as a silver salt of 5-chlorobenzotriazole, etc., a silver salt of 1,2,4-triazole, of 1H-tetrazole as described in U.S. Pat. No. 4,220,709, a silver salt of imidazole and an imidazole derivative, and the like.

It is also found convenient to use silver half soaps, of which an equimolar blend of silver behenate and behenic acid, prepared by precipitation from aqueous solution of the sodium salt of commercial behenic acid and analyzing about 14.5% silver, represents a preferred example. Transparent sheet materials made on transparent film backing require a transparent coating and for this purpose the silver behenate full soap, containing not more than about 4 or 5% of free behenic acid and analyzing about 25.2% silver may be used.

The method used for making silver soap dispersions is known in the art and is disclosed in *Research Disclosure*, April 1983, item no 22812; *Research Disclosure*, October 1983, item no. 23419; and U.S. Pat. No. 3,985,565.

The silver halide and the organic silver salt which are separately formed in a binder can be mixed prior to use to prepare a coating solution, but it is also effective to blend both of them in a ball mill for a long period of time. Further, it is effective to use a process which comprises adding a halogen-containing compound in the organic silver salt prepared to partially convert the silver of the organic silver salt to silver halide.

Methods of preparing these silver halide and organic silver salts and manners of blending them are described in *Research Disclosure*, No. 17029, Japanese Patent Applications No. 32928/75 and 42529/76, U.S. Pat. No. 3,700,458, and Japanese Patent Applications Nos. 13224/74 and 17216/75.

The silver halide and the non-photosensitive reducible silver source material that form a starting point of development should be in reactive association. By "reactive association" is meant that they should be in the same layer, in adjacent layers, or in layers separated from each other by an intermediate layer having a thickness of less than 1 micrometer (1 μm). It is preferred that the silver halide and the non-photosensitive reducible silver source material be present in the same layer.

Photothermographic emulsions containing preformed silver halide in accordance with this invention can be sensitized with chemical sensitizers, or with spectral sensitizers as described above.

The Reducing Agent for the Non-Photosensitive Reducible Silver Source

The reducing agent for the organic silver salt may be any material, preferably organic material, that can reduce silver ion to metallic silver. Conventional photographic developers such as phenidone, hydroquinones, and catechol are useful, but hindered phenol reducing agents are preferred.

A wide range of reducing agents has been disclosed in dry silver systems including amidoximes such as phenylamidoxime, 2-thienylamidoxime and p-phenoxyphenylamidoxime, azines (e.g., 4-hydroxy-3,5-dimethoxybenzaldehydeazine); a combination of aliphatic carboxylic acid aryl hydrazides and ascorbic acid, such as 2,2-bis(hydroxymethyl)propionylbetaphenyl hydrazide in combination with ascorbic acid; a combination of polyhydroxybenzene and hydroxylamine, a reductone and/or a hydrazine, e.g., a combination of hydroquinone and bis(ethoxyethyl)hydroxylamine, piperidinohexose reductone or formyl-4-methylphenylhydrazine, hydroxamic acids such as phenylhydroxamic acid, p-hydroxyphenylhydroxamic acid, and o-alaninehydroxamic acid; a combination of azines and sulfonamidophenols, e.g., phenothiazine and 2,6-dichloro-4-benzenesulfonamidophenol; α-cyanophenylacetic acid derivatives such as ethyl α-cyano-2-methylphenylacetate, ethyl α-cyano-phenylacetate; bis-o-naphthols as illustrated by 2,2'-dihydroxyl-1-binaphthyl, 6,6'-dibromo-2,2'-dihydroxy-1,1'-binaphthyl, and bis(2-hydroxy-1-naphthyl)methane; a combination of bis-o-naphthol and a 1,3-dihydroxybenzene derivative, (e.g., 2,4-dihydroxybenzophenone or 2,4-dihydroxyacetophenone); 5-pyrazolones such as 3-methyl-1-phenyl-5-pyrazolone; reductones as illustrated by dimethylaminohexose reductone, anhydrodihydroaminohexose reductone, and anhydrodihydro-piperidone-hexose reductone; sulfamidophenol reducing agents such as 2,6-dichloro-4-benzenesulfonamidophenol, and p-benzenesulfonamidophenol; 2-phenylindane-1,3-dione and the like; chromans such as 2,2-dimethyl-7-t-butyl-6-hydroxychroman; 1,4-dihydropyridines such as 2,6-dimethoxy-3,5-dicarbethoxy-1,4-dihydropyridine; bisphenols, e.g., bis(2-hydroxy-3-t-butyl-5-methylphenyl)methane; 2,2-bis(4-hydroxy-3-methylphenyl)propane; 4,4-ethylidene-bis(2t-butyl-6-methylphenol); and 2,2-bis(3,5-dimethyl-4-hydroxyphenyl)propane; ascorbic acid derivatives, e.g., 1-ascorbylpalmitate, ascorbylstearate and unsaturated aldehydes and ketones, such as benzyl and diacetyl; 3-pyrazolidones; and certain indane-1,3-diones.

The reducing agent should be present as 1 to 12% by weight of the imaging layer. In multilayer constructions, if the reducing agent is added to a layer other than an emulsion layer, slightly higher proportions, of from about 2 to 15%, tend to be more desirable.

The Optional Dye Releasing Material

The reducing agent for the reducible source of silver may be a compound that can be oxidized directly or indirectly to form or release a dye.

The dye-forming or releasing material may be any colorless or lightly colored compound that can be oxidized to a colored form, when heated, preferably to a temperature of from about 80° C. to about 250° C. (176° F. to 482° F.) for a duration of from about 0.5 to about 300 seconds. When used with a dye receiving layer, the dye can diffuse through emulsion layers and interlayers into the image receiving layer of the article of the invention.

Leuco dyes are one class of dye releasing material that form a dye upon oxidation. Any leuco dye capable of being oxidized by silver ion to form a visible image can be used in the present invention. Leuco dyes that are both pH sensitive and oxidizable can be used but are not preferred. Leuco dyes that are sensitive only to changes in pH are not included within scope of dyes useful in this invention because they are not oxidizable to a colored form.

As used herein, the term "change in color" includes (1) a change from an uncolored or lightly colored state (optical density less than 0.2) to a colored state (an increase in optical density of at least 0.2 units), and (2) substantial change in hue.

Representative classes of leuco dyes that are suitable for use in the present invention include, but are not limited to, bisphenol and bisnaphthol leuco dyes, phenolic leuco dyes, indoaniline leuco dyes, imidazole leuco dyes, azine leuco dyes, oxazine leuco dyes, diazine leuco dyes, and thiazine leuco dyes. Preferred classes of dyes are described in U.S. Pat. Nos. 4,460,681 and 4,594,307.

One class of leuco dyes useful in this invention are those derived from imidazole dyes. Imidazole leuco dyes are described in U.S. Pat. No. 3,985,565.

Another class of leuco dyes useful in this invention are those derived from so-called "chromogenic dyes." These dyes are prepared by oxidative coupling of a p-phenylenediamine with a phenolic or anilinic compound. Leuco dyes of this class are described in U.S. Pat. No. 4,594,307. Leuco chromogenic dyes having short chain carbamoyl protecting groups are described in copending application U.S. Serial No. 07/939,093, incorporated herein by reference.

A third class of dyes useful in this invention are "aldazine" and "ketazine" dyes. Dyes of this type are described in U.S. Pat. Nos. 4,587,211 and 4,795,697.

Another preferred class of leuco dyes are reduced forms of dyes having a diazine, oxazine, or thiazine nucleus. Leuco dyes of this type can be prepared by reduction and acylation of the color-bearing dye form. Methods of preparing leuco dyes of this type are described in Japanese Pat. No. 52-89131 and U.S. Pat. Nos. 2,784,186; 4,439,280; 4,563,415, 4,570,171, 4,622,395, and 4,647,525, all of which are incorporated herein by reference.

Another class of dye releasing materials that form a dye upon oxidation are known as preformed-dye-release (PDR) or redox-dye-release (RDR) materials. In these materials the reducing agent for the organic silver compound releases a preformed dye upon oxidation. Examples of these materials are disclosed in Swain, U.S. Pat. No. 4,981,775, incorporated herein by reference.

Also useful are neutral, phenolic leuco dyes such as 2-(3,5-di-t-butyl-4-hydroxyphenyl)-4,5-diphenylimidazole, or bis(3,5-di-t-butyl-4-hydroxyphenyl)phenylmethane. Other phenolic leuco dyes useful in practice of the present invention are disclosed in U.S. Pat. Nos. 4,374,921; 4,460,681; 4,594,307; and 4,782,010, which are incorporated herein by reference.

Other leuco dyes may be used in imaging layers as well, for example, benzylidene leuco compounds cited in U.S. Pat. No. 4,923,792, incorporated herein by reference. The reduced form of the dyes should absorb less strongly in the visible region of the electromagnetic spectrum and be oxidized by silver ions back to the original colored form of the dye. Benzylidene dyes have extremely sharp spectral characteristics giving high color purity of low gray level. The dyes have large extinction coefficients, typically on the order of $10^4$ to $10^5$ liter/ mole-cm, and possess good compatibility and heat stability. The dyes are readily synthesized and the reduced leuco forms of the compounds are very stable. Leuco dyes such as those disclosed in U.S. Pat. Nos. 3,442,224; 4,021,250; 4,022,617 and 4,368,247 are also useful in the present invention.

The dyes formed from the leuco dye in the various color-forming layers should, of course, be different. A difference of at least 60 nm in reflective maximum absorbance is preferred. More preferably, the absorbance maximum of dyes formed will differ by at least 80–100 nm. When three dyes are to be formed, two should preferably differ by at least these minimums, and the third should preferably differ from at least one of the other dyes by at least 150 nm, and more preferably, by at least 200 nm. Any leuco dye capable of being oxidized by silver ion to form a visible dye is useful in the present invention as previously noted.

The dyes generated by the leuco compounds employed in the elements of the present invention are known and are disclosed, for example, in *The Colour Index*; The Society of Dyes and Colourists: Yorkshire, England, 1971; Vol. 4, p. 4437; and Venkataraman, K. *The Chemistry of Synthetic Dyes*; Academic Press: New York, 1952; Vol. 2, p. 1206; U.S. Pat. No. 4,478,927, and Hamer, F. M. *The Cyanine Dyes and Related Compounds*; Interscience Publishers: New York, 1964; p. 492.

Leuco dye compounds may readily be synthesized by techniques known in the art. Suitable methods are disclosed, for example, in: F. X. Smith et al. *Tetrahedron Lett.* 1983, 24(45), 4951–4954; X. Huang., L. Xe, *Synth. Commun.* 1986, 16(13) 1701–1707; H. Zimmer et al. *J. Org. Chem.* 1960, 25, 1234–5; M. Sekiya et al. *Chem. Pharm. Bull.* 1972, 20(2),343; and T. Sohda et al. *Chem. Pharm. Bull.* 1983, 31(2) 560–5; H. A. Lubs *The Chemistry of Synthetic Dyes and Pigments*; Hafner; New York, NY; 1955 Chapter 5; in H. Zollinger *Color Chemistry: Synthesis, Properties and Applications of Organic Dyes and Pigments*; VCH; New York, NY; pp. 67–73, 1987, and in U.S. Pat. No. 5,149,807; and EPO Laid Open Application No. 0,244,399.

Further, as other image forming materials, materials where the mobility of the compound having a dye part changes as a result of an oxidation-reduction reaction with silver halide, or an organic silver salt at high temperature can be used, as described in Japanese Pat. Application No. 165054 (1984). Many of the above-described materials are materials wherein an image-wise distribution of mobile dyes corresponding to exposure is formed in the photosensitive material by heat development. Processes of obtaining visible images by transferring the dyes of the image to a dye fixing material (diffusion transfer) have been described in Japanese Pat. Application Nos. 168,439 (1984) and 182,447 (1984).

Still further, the reducing agent may be a compound that releases a conventional photographic dye coupler or developer on oxidation as is known in the art. When the photothermographic material of this invention is heat developed in a substantially water-free condition after or simultaneously with imagewise exposure, a mobile dye image is obtained simultaneously with the formation of a silver image either in exposed areas or in unexposed areas with exposed photosensitive silver halide.

The total amount of reducing agent utilized in the present invention should preferably be in the range of 0.5–25 weight %, and more preferably in the range of 1-10 weight %, based upon the total weight of each individual layer in which the reducing agent is employed.

The Binder

The photosensitive silver halide and the organic silver salt oxidizing agent used in the present invention are generally added to at least one binder as described herein below.

It is preferred that the binder be sufficiently polar to hold the other ingredients of the emulsion in solution. It is preferred that the binder be selected from polymeric materials, such as, for example, natural and synthetic resins, such as gelatin, polyvinyl acetals, polyvinyl chloride, polyvinyl acetate, cellulose acetate, polyolefins, polyesters, polystyrene, polyacrylonitrile, polycarbonates, methacrylate copolymers, maleic anhydride ester copolymers, butadiene-styrene copolymers, and the like. Copolymers, e.g. terpolymers, are also included in the definition of polymers.

The binder(s) that can be used in the present invention can be employed individually or in combination with one another. The binder may be hydrophilic or hydrophobic. A typical hydrophilic binder is a transparent or translucent hydrophilic colloid, examples of which include a natural substance, for example, a protein such as gelatin, a gelatin derivative, a cellulose derivative, etc.; a polysaccharide such as starch, gum arabic, pullulan, dextrin, etc.; and a synthetic polymer, for example, a water-soluble polyvinyl compound such as polyvinyl alcohol, polyvinyl pyrrolidone, acrylamide polymer, etc. Another example of a hydrophilic binder is a dispersed vinyl compound in latex form which is used for the purpose of increasing dimensional stability of a photographic material.

Polyvinyl acetals, such as polyvinyl butyral and polyvinyl formal, and vinyl copolymers such as polyvinyl acetate and polyvinyl chloride are particularly preferred. The preferred binder for the photothermographic material is poly(vinyl butyral). The binders can be used individually or in combination with one another. Although the binder may be hydrophilic or hydrophobic; it is preferably hydrophobic.

The binders are generally used at a level of from about 20 to about 75% by weight of the emulsion layer, and preferably from about 30 to about 55% by weight. Where the proportions and activities of leuco dyes require a particular developing time and temperature, the binder should be able to withstand those conditions. Generally, it is preferred that the binder not decompose or lose its structural integrity at 200° F. (90° C.) for 30 seconds, and more preferred that it not decompose or lose its structural integrity at 300° F. (149° C.) for 30 seconds.

Optionally, these polymers may be used in combination of two or more thereof. Such a polymer is used in an amount sufficient to carry the components dispersed therein; that is, within the effective range of the action as the binder. The effective range can be appropriately determined by one skilled in the art. As a guide in the case of carrying at least an organic silver salt, it can be said that a preferable ratio of the binder to the organic silver salt ranges from 15:1 to 1:2, and particularly from 8:1 to 1:1.

Dry Silver Formulations

The formulation for the photothermographic emulsion layer can be prepared by dissolving and dispersing the binder; the photosensitive silver halide; the non-photosensitive, reducible silver source; the reducing agent for the non-photosensitive reducible silver source (as, for example, the optional leuco dye); the fluorinated polymer of this invention; and optional additives, in an inert organic solvent, such as, for example, toluene, 2-butanone, or tetrahydrofuran.

The use of "toners" or derivatives thereof which improve the image, is highly desirable, but is not essential to the element. Toners may be present in amounts of from 0.01 to 10% by weight of the emulsion layer, preferable 0.1 to 10% by weight. Toners are well known materials in the photothermographic art as shown in U.S. Pat. Nos. 3,080,254; 3,847,612; and 4,123,282.

Examples of toners include phthalimide and N-hydroxyphthalimide; cyclic imides such as succinimide, pyrazoline-5-ones, and a quinazolinone, 1-phenylurazole, 3-phenyl-2-pyrazoline-5-one, quinazoline and 2,4-thiazolidinedione; naphthalimides such as N-hydroxy-1,8-naphthalimide; cobalt complexes such as cobaltic hexamine trifluoroacetate; mercaptans as illustrated by 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl-)aryldicarboximides, e.g. (N-dimethylaminomethyl)-phthalimide, and N-(dimethylaminomethyl)naphthalene-2,3-dicarboximide; and a combination of blocked pyrazoles, isothiuronium derivatives and certain photobleach agents, e.g., a combination of N,N'-hexa-methylene-bis(1-carbamoyl-3,5-dimethylpyrazole), 1,8-(3,6-diazaoctane)-bis(isothiuronium)trifluoroacetate and 2-(tribromomethylsulfonylbenzothiazole); and merocyanine dyes such as 3-ethyl-5-[(3-ethyl-2-benzothiazolinylidene)-1methyl-ethylidene]-2-thio-2,4-oazolidinedione; phthal-azinone, phthalazinone derivatives or metal salts or these derivatives such as 4-(1-naphthyl)phthalazinone, 6-chlorophthalazinone, 5,7-dimethoxyphthalazinone, and 2,3-dihydro-1,4-phthalazinedione; a combination of phthalazinone plus sulfinic acid derivatives, e.g., phthalic acid, 4-methylphthalic acid, 4-nitrophthalic acid, and tetrachlorophthalic anhydride; quinazolinediones, benzoxazine or naphthoxazine derivatives; rhodium complexes functioning not only as tone modifiers but also as sources of halide ion for silver halide formation in situ, such as ammonium hexachlororhodate (III), rhodium bromide, rhodium nitrate and potassium hexachlororhodate (III); inorganic peroxides and persulfates, e.g., ammonium peroxydisulfate and hydrogen peroxide; benzoxazine-2,4-diones such as 1,3-benzoxazine-2,4-dione, 8-methyl-1,3-benzoxazine-2,4-dione, and 6-nitro-1,3-benzoxazine-2,4-dione; pyrimidines and asym-triazines, e.g., 2,4-dihydroxypyrimidine, 2-hydroxy-4-aminopyrimidine, and azauracil, and tetrazapentalene derivatives, e.g., 3,6-dimercapto-1,4-diphenyl-1H, 4H-2,3a,5,6a-tetrazapentalene, and 1,4-di(o-chlorophenyl)-3,6-dimercapto-1H, 4H-2,3a,5,6a-tetrazapentalene.

Silver halide emulsions used in this invention may be protected further against the additional production of fog and can be stabilized against loss of sensitivity during keeping. While not necessary for the practice of the invention, it may be advantageous to add mercury (II) salts to the emulsion layer(s) as an antifoggant. Preferred mercury (II) salts for this purpose are mercuric acetate and mercuric bromide.

Suitable antifoggants and stabilizers which can be used alone or in combination, include the thiazolium salts described in Staud, U.S. Pat. No. 2,131,038 and Allen U.S. Pat. No. 2,694,716; the azaindenes described in Piper, U.S. Pat. No. 2,886,437 and Heimbach, U.S. Pat. No. 2,444,605; the mercury salts described in Allen, U.S. Pat. No. 2,728,663; the urazoles described in Anderson, U.S. Pat. No. 3,287,135; the sulfocatechols described in Kennard, U.S. Pat. No. 3,235,652; the oximes described in Carrol et al., British Pat. No. 623,448; the polyvalent metal salts described in Jones, U.S. Pat. No. 2,839,405; the thiuronium salts described by Herz, U.S. Pat. No. 3,220,839; and palladium, platinum and gold salts described in Trivelli, U.S. Pat. No. 2,566,263 and Damschroder, U.S. Pat. No. 2,597,915.

Stabilized emulsions used in the invention can contain plasticizers and lubricants such as polyalcohols, e.g., glycerin and diols of the type described in Milton, U.S. Pat. No. 2,960,404; fatty acids or esters such as those described in Robins, U.S. Pat. No. 2,588,765 and Duane, U.S. Pat. No. 3,121,060; and silicone resins such as those described in British Pat. No. 955,061.

The photothermographic elements can include image dye stabilizers. Such image dye stabilizers are illustrated by U.K. Patent No. 1,326,889; U.S. Pat. Nos. 3,432,300 and 3,698,909; 3,574,627;. 3,573,050; 3,764,337; and 4,042,394.

The photothermographic elements can further contain inorganic or organic hardeners. When used with hydrophilic binders, it is possible to use chromium salts such as chromium alum, chromium acetate, etc.; aldehydes such as formaldehyde, glyoxal, glutaraldehyde, etc.; N-methylol compounds such as dimethylolurea, methylol dimethyl-hydantoin, etc.; dioxane derivatives such as 2,3-dihydroxydioxane, etc.; active vinyl compounds such as 1,3,5-triacryloylhexahydro-s-triazine, 1,3-vinylsulfonyl-2-propanol, etc.; active halogen compounds such as 2,4-dichloro-6-hydroxy-s-triazine, etc.; mucohalogenic acids such as mucochloric acid, and mucophenoxychloric acid, etc.; which may be used individually or as a combination thereof. When used with hydrophobic binders, it is possible to use compounds such as poly-isocyanates, epoxy resins, melamines, phenolic resins, and dialdehydes as harderners.

Photothermographic elements containing stabilized emulsion layers can be used in photographic elements which contain light absorbing materials and filter dyes such as those described in Sawdey, U.S. Pat. No. 3,253,921; Gaspar U.S. Pat. No. 2,274,782; Carroll et al., U.S. Pat. No. 2,527,583 and Van Campen, U.S. Pat. No. 2,956,879. If desired, the dyes can be mordanted, for example, as described in Milton, U.S. Pat. No. 3,282,699.

Photothermographic elements containing stabilized emulsion layers can contain matting agents such as starch, titanium dioxide, zinc oxide, silica, polymeric beads including beads of the type described in Jelley et al., U.S. Pat. No. 2,992,101 and Lynn, U.S. Pat. No. 2,701,245.

Stabilized emulsions can be used in photothermographic elements which contain antistatic or conducting layers, such as layers that comprise soluble salts, e.g., chlorides, nitrates, etc., evaporated metal layers, ionic polymers such as those described in Minsk, U.S. Pat. Nos. 2,861,056, and 3,206,312 or insoluble inorganic salts such as those described in Trevoy, U.S. Pat. No. 3,428,451.

The photothermographic dry silver emulsions of this invention may be constructed of one or more layers on a substrate. Single layer constructions should contain the silver source material, the silver halide, the developer, and binder as well as optional materials such as toners, coating aids, leuco dyes, and other adjuvants. Two-layer constructions should contain the silver source and silver halide in one emulsion layer (usually the layer adjacent to the substrate) and some of the other ingredients in the second layer or both layers, although two layer constructions comprising a single emulsion layer coating containing all the ingredients and a protective topcoat are envisioned. Multicolor photothermographic dry silver constructions may contain sets of these bilayers for each color or they may contain all ingredients within a single layer as described in U.S. Pat. No. 4,708,928. In the case of multilayer, multicolor photothermographic articles, the various emulsion layers are generally maintained distinct from each other by the use of functional or non-functional barrier layers between the various photosensitive layers as described in U.S. Pat. No. 4,460,681.

The photothermographic dry silver emulsions can be coated on the substrate by any suitable "simultaneous wet-on-wet" coating procedure such as by dual-knife coating; dual-roll coating; dual-slot coating; dual-slide coating; and dual-curtain coating.

The coating amount of the photothermographic or thermographic emulsion layer used in the present invention is from 10 g per $m^2$ to 30 g per $m^2$, preferably from 18 g per $m^2$ to 22 g per $m^2$.

The coated constructions can be dried using any suitable method such as, for example, by using an oven; countercurrent parallel air flow; impingement air; infrared light; radiant heating; microwave; or heated rollers.

Development conditions will vary, depending on the construction used, but will typically involve heating the imagewise exposed material at a suitably elevated temperature, e.g. from about 80° C. to about 250° C., preferably from about 120° C. to about 200° C., for a sufficient period of time, generally from 1 second to 2 minutes.

In some methods, the development is carried out in two steps. Thermal development takes place at a higher temperature, e.g. about 150° C. for about 10 seconds, followed by thermal diffusion at a lower temperature, e.g. 80° C., in the presence of a transfer solvent. The second heating step at the lower temperature prevents further development and allows the dyes that are already formed to diffuse out of the emulsion layer to the receptor layer.

The Support

Photothermographic and thermographic emulsions used in the invention can be coated on a wide variety of supports. The support or substrate can be selected from a wide range of materials depending on the imaging requirement. Typical supports include polyester film, subbed polyester film, poly(ethylene terephthalate) film, cellulose nitrate film, cellulose ester film, poly(vinyl acetal) film, polycarbonate film and related or resinous materials, as well as glass, paper, metal and the like. Typically, a flexible support is employed, especially a paper support, which can be partially acetylated or coated with baryta and/or an $\alpha$-olefin polymer, particularly a polymer of an alphaoolefin containing 2 to 10 carbon atoms such as polyethylene, polypropylene, ethylene-butene copolymers and the like. Preferred polymeric materials for the support include polymers having good heat stability, such as polyesters. A particularly preferred polyester is polyethylene terephthalate.

Photothermographic and thermographic emulsions used in this invention can be coated by various coating procedures including, wire wound rod coating, dip coating, air knife coating, curtain coating, or extrusion coating using hoppers of the type described in U.S. Pat. No. 2,681,294. If desired, two or more layers may be coated simultaneously by the procedures described in U.S. Pat. No. 2,761,791 and British Patent No. 837,095. Typical wet thickness of the emulsion layer can range from about 10 to about 100 $\mu$m, and the layer can be dried in forced air at temperatures ranging from 20° C. to 100° C. It is preferred that the thickness of the layer be selected to provide maximum image densities greater than 0.2, and more preferably in the range 0.5 to 2.5, as measured by a MacBeth Color Densitometer Model TD 504 using the color filter complementary to the dye color.

Alternatively, the formulation may be spray-dried or encapsulated to produce solid particles, which can then be redispersed in a second, possibly different, binder and then coated onto the support.

The formulation for the emulsion layer can also include coating aids such as fluoroaliphatic polyesters.

Barrier layers, preferably comprising a polymeric material, may also be present in the photothermographic element of the present invention. Polymers for the material of the barrier layer can be selected from natural and synthetic polymers such as gelatin, polyvinyl alcohols, polyacrylic acids, sulfonated polystyrene, and the like. The polymers can optionally be blended with barrier aids such as silica.

The substrate with backside resistive heating layer may also be used in color photothermographic imaging systems such as shown in U.S. Pat. Nos. 4,460,681 and 4,374,921.

The Dye-Receiving Layer

When the reactants and reaction products of photothermographic systems that contain compounds capable of being oxidized to form or release a dye remain in contact after imaging, several problems can result. For example, thermal development often forms turbid and hazy color images because of dye contamination of the reduced metallic silver image on the exposed area of the emulsion. In addition, the resulting prints tend to develop color in unimaged background areas. This "background stain" is caused by slow reaction between the dye forming or dye releasing compound and reducing agent during storage. It is therefore desirable to transfer the dye formed upon imaging to a receptor. The receptor is often referred to as an imaging-receiving layer or a dye-receiving layer.

The photothermographic element may further comprise an dye-receiving layer. Dyes generated during thermal development of light-exposed regions of the emulsion layers may migrate under development conditions into an dye-receiving or dye-receiving layer wherein they are retained. Images derived from the photothermographic elements employing compounds capable of being oxidized to form or release a dye, as for example, leuco dyes are typically transferred to a dye-receiving layer. The dye-receiving layer may be composed of a polymeric material having affinity for the dyes employed. Necessarily, it will vary depending on the ionic or neutral characteristics of the dyes.

The dye-receiving layer of this invention can be any flexible or rigid, transparent layer made of thermoplastic polymer. The dye-receiving layer preferably has a thickness of at least 0.1 μm, more preferably from about 1 to about 10 μm, and a glass transition temperature of from about 20° C. to about 200° C. In the present invention, any thermoplastic polymer or combination of polymers can be used, provided the polymer is capable of absorbing and fixing the dye. Because the polymer acts as a dye mordant, no additional fixing agents are required. Thermoplastic polymers that can be used to prepare the dye-receiving layer include polyesters, such as polyethylene terephthalates; polyolefins, such as polyethylene; cellulosics, such as cellulose acetate, cellulose butyrate, cellulose propionate; polystyrene; polyvinyl chloride; polyvinylidine chloride; polyvinyl acetate; copolymer of vinylchloride-vinylacetate; copolymer of vinylidene chloride-acrylonitrile; copolymer of styrene-acrylonitrile; and the like.

Examples of organic polymeric materials used in the dye-receiving material of this invention include polystyrene having a molecular weight of 2,000 to 85,000, polystyrene derivatives having substituents with not more than 4 carbon atoms, poly(vinylcyclohexene), poly(divinylbenzene), poly(N-vinylpyrrolidine), poly(vinylcarbazole), poly(allylbenzene), poly(vinyl alcohol), polyacetals such as polyvinyl formal and polyvinyl butyral, polyvinyl chloride, chlorinated polyethylene, polytrifluoroethylene, polyacrylonitrile, poly(N,N-dimethylallylamide), polyacrylates having a p-cyanophenyl group, a pentachlorophenyl group or a 2,4-dichlorophenyl group, poly(acryl chloroacrylate), poly(methyl methacrylate), poly(ethyl methacrylate), poly(propyl methacrylate), poly(isopropyl methacrylate), poly(isobutyl methacrylate), poly(tert-butyl methacrylate), poly(cyclohexyl methacrylate), polyethylene glycol dimethacrylate, poly(cyanoethyl methacrylate), polyesters such as polyethylene terephthalate, polysulfone Bisphenol A polycarbonate, polycarbonates, polyanhydrides, polyamides and cellulose acetate. The synthetic polymers described in "*Polymer Handbook*", 2nd Edition (edited by J. Brandrup and E. H. Immergut, published by John Wiley and Sons, Inc.) are also useful. These polymeric substances may be used singly, or a plurality of them may be used in the form of a copolymer.

The optical density of the dye image and even the actual color of the dye image in the dye-receiving layer is very much dependent on the characteristics of the polymer of the dye-receiving layer, which acts as a dye mordant, and, as such, is capable of absorbing and fixing the dyes. A dye image having a reflection optical density in the range of from 0.3 to 3.5 (preferably from 1.5 to 3.5) or a transmission optical density in the range of from 0.2 to 2.5 (preferably from 1.0 to 2.5) can be obtained with the present invention.

The dye-receiving layer can be formed by dissolving at least one thermo-plastic polymer in an organic solvent (e.g., 2-butanone, acetone, tetrahydrofuran) and applying the resulting solution to a support base or substrate by various coating methods known in the art, such as curtain coating, extrusion coating, dip coating, air-knife coating, hopper coating, and any other coating method used for coating solutions. After the solution is coated, the dye-receiving layer is dried (e.g., in an oven) to drive off the solvent. The dye-receiving layer may be strippably adhered to the photothermographic element. Strippable image receiving layers are described in U.S. Pat. No. 4,594,307, incorporated herein by reference.

Selection of the binder and solvent to be used in preparing the emulsion layer significantly affects the strippability of the dye-receiving layer from the photosensitive element. Preferably, the binder for the image-receiving layer is impermeable to the solvent used for coating the emulsion layer and is incompatible with the binder used for the emulsion layer. The selection of the preferred binders and solvents results in weak adhesion between the emulsion layer and the dye-receiving layer and promotes good strippability of the emulsion layer.

The photothermographic element can also include coating additives to improve the strippability of the emulsion layer. For example, fluoroaliphatic polyesters dissolved in ethyl acetate can be added in an amount of from about 0.02 to about 0.5 weight % of the emulsion layer, preferably from about 0.1 to about 0.3 weight %. A representative example of such a fluoroaliphatic polyester is "FLUORAD FC 431", (a fluorinated surfactant, available from 3M Company, St. Paul, Minn.). Alternatively, a coating additive can be added to the dye-receiving layer in the same weight range to enhance strippability. No solvents need to be used in the stripping process. The strippable layer preferably has a delaminating resistance of 1 to 50 g/cm and a tensile strength at break greater than, preferably at least two times greater than, its delaminating resistance.

Preferably, the dye-receiving layer is adjacent to the emulsion layer to facilitate transfer of the dye that forms after the imagewise exposed emulsion layer is subjected to thermal development, for example, in a heated shoe-and-roller type heat processor.

Multi-layer constructions containing blue-sensitive emulsions containing a yellow leuco dye of this invention may be overcoated with green-sensitive emulsions containing a magenta leuco dye of this invention. These layers may in turn be overcoated with a red-sensitive emulsion layer containing a cyan leuco dye. Imaging and heating form the yellow, magenta, and cyan images in an imagewise fashion. The dyes so formed may migrate to an image receiving layer. The image receiving layer may be a permanent part of the construction or may be removable "i.e., strippably adhered" and subsequently peeled from the construction. Color forming layers may be maintained distinct from each other by the use of functional or non-functional barrier layers between the various photo-sensitive layers as described in U.S. Pat. No. 4,460,681. False color address, such as that shown in U.S. Pat. No. 4,619,892 may also be used rather than blue-yellow, green-magenta, or red-cyan relationships between sensitivity and dye formation.

In another embodiment, the colored dye released in the emulsion layer can be transferred onto a separately coated dye-receiving sheet by placing the exposed emulsion layer in intimate face-to-face contact with the dye-receiving sheet and heating the resulting composite construction. Good results can be achieved in this second embodiment when the layers are in uniform contact for a period of time of from 0.5 to 300 seconds at a temperature of from about 80° C. to about 220° C.

Multi-color images can be prepared by superimposing, in register, imaged dye-receiving layers as prepared above. The polymers of the individual imaged image-receiving layers must be sufficiently adherent to provide useful multi-color reproduction on a single substrate.

Objects and advantages of this invention will now be illustrated by the following examples, but the particular materials and amounts thereof recited in these examples, as well as other conditions and details, should not be construed to unduly limit this invention. All percentages are by weight unless otherwise indicated.

EXAMPLES

All materials used in the following examples are readily available form standard commercial sources such as Aldrich Chemical Company, (Milwaukee, Wis.) unless otherwise noted.

BL-2 poly(vinyl butyral) is available from Sekisui Company, Japan.

BX-5 poly(vinyl butyral) is available from Sekisui Company, Japan.

Permanax WSO is 1,1-bis(2-hydroxy-3,5-dimethylphenyl)-3,5,5-trimethylhexane [CAS RN=7292-14-0]. It is available from Vulnax International Ltd. It is also known as Nonox WSO.

Sensitizing Dye A has the following formula:

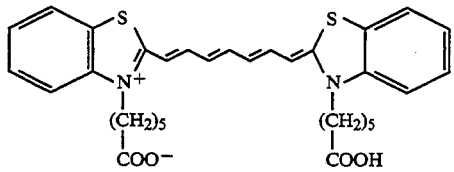

Sensitizing Dye B has the following formula:

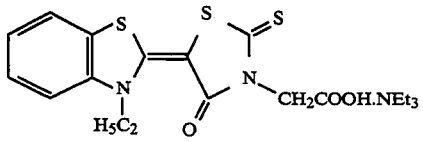

Sensitizing Dye C has the following formula:

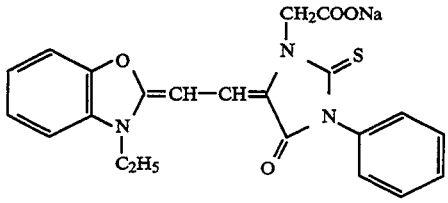

Et-FOSEMA is an abbreviation for N-ethylperfluorooctanesulfonamidoethyl methacrylate and has the formula $C_8F_{17}SO_2N(C_2H_5)CH_2CH_2OCOC(CH_3)=CH_2$. It is available from 3M Company, St. Paul, Minn.

Bu-FOSEA is an abbreviation for N-butylperfluorooctanesulfonamidoethyl acrylate and has the formula $C_8F_{17}SO_2N(C_4H_9)CH_2CH_2OCOCH=CH_2$. It is available from 3M Company, St. Paul, Minn.

Me-FOSEA is an abbreviation for N-methylperfluorooctanesulfonamidoethyl acrylate $C_8F_{17}SO_2N(CH_3)CH_2CH_2OCOCH=CH_2$. It is available from 3M Company, St. Paul, Minn.

FOMA is an abbreviation for 1,1-dihydroperfluorooctyl methacrylate and has the formula $C_7F_{15}CH_2OCOC(CH_3)=CH_2$. It is available from 3M Company, St. Paul, Minn.

FOA is an abbreviation for 1,1-dihydroperfluorooctyl acrylate and has the formula $C_7F_{15}CH_2O_2CCH=CH_2$. It is available from 3M Company, St. Paul, Minn.

PcHMA is an abbreviation for perfluorocyclohexyl)-methyl methacrylate and has the formula $C_6F_{11}CH_2OCOC(CH_3)=CH_2$. It is available from 3M Company, St. Paul, Minn.

HEMA is an abbreviation for hydroxyethyl methacrylate and has the formula $HOCH_2CH_2OCOC(CH_3)=CH_2$. It is available from 3M Company, St. Paul, Minn.

BuMA is an abbreviation for butylmethacrylate.

ODMA is an abbreviation for octadecylmethacrylate. It is available from Rohm and Haas, Philadelphia, Pa.

DMAEMA is an abbreviation for $(CH_3)_2NCH_2CH_2O_2CC(CH_3)=CH_2$ [2-(dimethylamino)ethyl methacrylate]. It is available from Aldrich Chemical Co.

FC-430 and FC-431 are fluorochemical surfactants available from 3M Company, St. Paul, Minn.

AA is an abbreviation for acrylic acid and has the formula $HO_2CCH{=}CH_2$.

Preparation of Surfactants

The following represents a typical preparation of a surfactant of the invention. Other surfactants were prepared in a similar manner by substituting appropriate materials.

A terpolymer surfactant of Et-FOSEMA/-HEMA/AA was prepared by dissolving 7.0 g (0.011 mol) of Et-FOSEMA (3M Company, St. Paul, Minn.), 2.0 g (0.015 mol) of hydroxyethyl methacrylate (Aldrich Chemical Co., Milwaukee, Wis.), 1.0 g (0.014 mol) of acrylic acid (Aldrich Chem, Milwaukee, Wis.), 0.4 g of t-butylperoctoate (Atochem North America, Philadelphia, Pa) and 0.2 g of 3-mercapto-1,2-propanediol (Aldrich Chemical Co., Milwaukee, Wis.) in 47 g of ethyl acetate. The polymerization solution was purged with nitrogen through a dip tube for two minutes and then sealed. The sealed bottle was shaken at 85° C. for four hours after which the bottle was allowed to cool to room temperature and air was admitted. Some precipitation of the polymer was noted and 28 g of isopropyl alcohol was added and the mixture agitated. The solution then appeared to be homogeneous. The polymer has the structure shown below; m, n, and p are integers and denote the random nature of the polymerization.

Examples 1–5 demonstrate the use of fluorochemical surfactants of this invention in preparation and use of photothermographic coatings. In Example 1, the samples were dried by being placed in an oven. In Example 2, the samples were dried using countercurrent parallel air flow. In Example 3, the samples were dried using impingement air. As shown below, the fluorochemical surfactants of this invention are effective in reducing mottle irrespective of the method used for drying the samples.

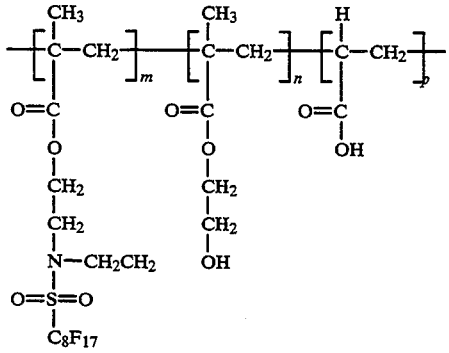

Example 1

A silver halide-silver behenate dry soap was prepared by the procedures described in U.S. Pat. No. 3,839,049. The silver halide totaled 9% of the total silver while silver behenate comprised 91% of the total silver. The silver halide was a 0.055 micron silver bromoiodide emulsion with 2% iodide.

A dispersion of silver behenate preformed soap was made by combining the silver halide/silver behenate dry soap, BL-2 poly(vinyl butyral), toluene, and 2-butanone in the ratios shown below.

| Component | Weight Percent |
|---|---|
| dry soap | 19.16% |
| poly(vinyl butyral) | 2.03% |
| toluene | 10.28% |
| 2-butanone | 68.53% |

To 183.57 g of the pre-formed silver soap dispersion, 47.31 g of 2-butanone and 0.22 g of pyridinium hydrobromide perbromide were added. After 10 minutes of mixing, 1.428 g of a 10.3 wt. % mixture of calcium bromide in ethanol was added and mixed for 15 minutes. Sekisui BL-2 poly(vinyl butyral), 34.39 g, was then added and mixing was continued for 2 hours. After the resin had dissolved, a premix consisting of 0.035 g of 2-mercapto-5-methylbenzimidazole (a supersensitizer for Dye A), 1.24 g of 2-(4-chlorobenzoyl)benzoic acid, 0.021 g of Sensitizing Dye A, and 7.53 g of ethanol were added. Sensitizing Dye A is a carboxyalkyl-substituted cyanine dye having the formula shown earlier herein. After mixing for 15 minutes, 8.157 g of Permanax WSO was added and mixed for an additional 15 minutes. Finally, 15.99 g of a solution of 0.78 g of 2-tribromomethylsulfonyl-5-methylthiadiazole in 15.21 g of 2-butanone was added and mixed for 15 minutes.

A top-coat solution was prepared by adding 7.93 g of Sekisui BX-5 poly(vinyl butyral) to 301.81 g of 2-butanone and 47.58 g of ethanol and mixing until the resin dissolved. This was followed by addition of 3.61 g of phthalazine, 1.66 g of tetrachlorophthalic anhydride, 1.15 g of tetrachlorophthalic acid, and 1.89 g of 4-methylphthalic acid. After mixing for 15 minutes, 208.60 g of 2-butanone was added, followed by 25.77 g of Sekisui BX-5 poly(vinyl butyral) resin and the solution was mixed for approximately 2 hours. The top-coat was then split into two portions. To one portion was added surfactant Et-FOSEMA/ HEMA/AA (70/20/10) at 0.1% by weight of the total top-coat solution. No surfactant was added to the other portion; it served as a control.

A double-knife coater was used to coat the dispersions. The substrate used was 7 mil polyethyleneterephthalate. The knives were then lowered and locked into place. The height of the knives was adjusted with wedges controlled by screw knobs and measured with electronic gauges. Knife #1 was raised to a clearance corresponding to the desired wet thickness of the substrate plus layer #1. Layer #1 was coated at a wet thickness of 4.6 mil (116.84 μm) above the substrate. Knife #2 was raised to a height equal to the desired wet thickness of the substrate plus layer #1 plus layer #2. Layer #2 was coated at a wet thickness of 2.2 rail (55.9 μm) above layer #1.

Aliquots of solutions #1 and #2 were simultaneously poured onto the substrate in front of the corresponding knives. The substrate was immediately drawn past the knives and into an oven to produce a double layered coating. The coated photothermographic material was then dried by taping the substrate to a belt which was rotated inside a BlueM oven maintained at 80° C. for approximately 2.5 minutes.

Samples of each photothermographic material were exposed to reflected white light at low intensity for 25 seconds and then developed using a hot roll processor at approximately 255° F. The developed films were then visually inspected for mottle. The sample which contained surfactant showed a reduced level of mottle when visually inspected. The sample without surfactant was mottled.

Example 2

2-Butanone, 6.31 lb (2.87 Kg) and 14.51 g of pyridinium hydrobromide perbromide were added to 24.48 lb (11.12 Kg) of the preformed silver soap dispersion previously described. After 10 minutes of mixing, 87.09 g of a 10.3 wt. % premix of calcium bromide in ethanol was added and mixed for 15 minutes.

BL-2 poly(vinyl butyral) (2.080 Kg) was added and allowed to mix for 2 hours. After the resin had dissolved, a premix consisting of 76.20 g of 2-(4-chlorobenzoyl)benzoic acid, 0.02 1 g of Sensitizing Dye B and 455.4 g of ethanol was added. After mixing for 15 minutes, 493.5 g of Permanax WSO was added and mixed for another 15 minutes. Finally, 967.06 g of a solution of 47.17 g of 2-tribromomethylsulfonyl-5-methylthiadiazole in 919.87 g of 2-butanone solution was added and mixed for 15 minutes.

The top-coat solution was prepared by mixing 80.10 lb (36.4 Kg) of 2-butanone and 9.91 lb (4.50 Kg) of ethanol. To these solvents, 179.28 g of tetrachlorophthalic anhydride, 204.01 g of 4-methylphthalic acid, 123.67 g of tetrachlorophthalic acid, and 389.45 g of phthalazine were added individually and mixed for 5 minutes each. Finally, 8.02 lb (3.65 Kg) of Sekisui BX-5 poly(vinyl butyral) resin was added and the solution was mixed for 2 hours. The top-coat was split into 9 batches. To 8 of these an amount of surfactant equal to 0.1 wt% of the total solution was added. The remaining sample contained no surfactant; it served as a control. Each solution was dual slot coated with the silver solution and dried in an oven using countercurrent parallel air flow as the drying medium. Samples of the films were exposed to reflected white light and then developed on a hot roll.

The processed samples were visually inspected for mottle content. The table below summarizes the results of this example. Each of the surfactants with the Et-FOSEMA/HEMA/AA construction showed some capability of reducing mottle when compared to a control example without surfactant. The constructions with Et-FOSEMA/HEMA/AA mass ratios of 70/20/10 and 70/10/20 appeared to have the largest ability to reduce mottle. It should be noted that removal of the acrylic acid group in the polymer results in a surfactant that fails to reduce mottle. Similarly, replacement of the ethyl group with a butyl group in the fluorochemical acrylate portion of the terpolymer appears to result in a surfactant that is less effective in reducing mottle.

| Surfactant Added | Mass Ratios | Reduction of Mottle |
|---|---|---|
| None | | None |
| Et-FOSEMA/HEMA/AA | 75/15/10 | Reduced |
| Et-FOSEMA/HEMA/AA | 75/10/15 | Reduced |
| Et-FOSEMA/HEMA/AA | 70/20/10 | Reduced |
| Et-FOSEMA/HEMA/AA | 70/10/20 | Reduced |
| Et-FOSEMA/HEMA/AA | 60/30/10 | Reduced |
| ET-FOSEMA/HEMA | 70/30 | None |
| Bu-FOSEA/HEMA/AA | 70/20/10 | None to little |
| Bu-FOSEA/HEMA/AA | 70/30 | None to little |

Example 3

This example demonstrates the use of impingement air as a drying medium. Sensitizing Dye C was substituted for the combination of Sensitizing Dye A +2-mercapto-5-methylbenzimidazole so that coating could take place in red light rather than ir-safelights.

Silver behenate dispersions and top-coat solutions were prepared as described in Example 2. The solution was split into two batches. To one was added surfactant Et-FOSEMA/HEMA/AA (70/20/10) at 0.1% by weight. Again, each top-coat was dual slot coated over the silver dispersion. The wet film was dried in an oven using impingement air as the drying medium. After exposure and development, the sample which contained surfactant showed a reduced level of motile when visually inspected. The sample without surfactant was mottled.

Example 4

Silver behenate dispersions and top-coat solutions were made as described in Example 1. The top-coat was again split into eight portions and the surfactants listed in the tables below were added to 0.1% by weight. After exposure and development, the sample which contained surfactant showed a reduced level of mottle when visually inspected. The sample without surfactant was mottled. Replacing the Et-FOSEMA with FOMA or Me-FOSEA appeared to not restrict the ability of the polymer surfactant to reduce mottle.

| Surfactant Added | Mass Ratios | Reduction of Mottle |
|---|---|---|
| None | | None |
| Et-FOSEMA/HEMA(E/O)/AA | 70/20/10 | None |
| Et-FOSEMA/HEMA(E/O)/AA | 54/39/7 | None |
| PcHMA/HEMA/AA | 70/20/10 | None to slight |
| FOMA/HEMA/AA | 70/20/10 | None to slight |
| FOMA/HEMA/AA | 62/25/13 | Reduced |
| Me-FOSEA/HEMA/AA | 70/20/10 | Reduced |
| Me-FOSEA/HEMA/AA | 69/20/11 | Reduced |

HEMA(E/O) is an adduct of 1.0 mol hydroxyethylmethacrylate and 4.5 mol of ethylene oxide.

Example 5

Silver behenate dispersions and top-coat solutions were made as described in Example 1. The top-coat was again split into seven portions and the surfactants listed in the table below were added to 0.1% by weight. After exposure and development, the samples were inspected for mottle. Under these conditions, none of the following surfactants were able to reduce mottle. The first two experiments below are described in allowed copending U.S. patent application Ser. No. 07/966,458. The last two experiments demonstrate the ineffectiveness of common surfactants in reducing mottle in photothermographic and thermographic elements. All of the surfactants used in Example 5 lack one or more critical features of the fluorinated polymer of this invention.

| Surfactant Added | Mass Ratios | Reduction of Mottle |
|---|---|---|
| Et-FOSEMA/BUMA/AA | 35/52/13 | None |
| Et-FOSEMA/ODMA/AA | 50/30/20 | None |
| Et-FOSEMA/BUMA/DMAEMA | 50/40/10 | None |
| MMA/FOA/FOMA | 25/38/37 | None |
| Et-FOSEMA/HEMA/MMA/AA | 60/10/20/10 | None |
| FC-430 | | None |
| FC-431 | | None |

Reasonable variations and modifications are possible from the foregoing disclosure without departing from either the spirit or scope of the present invention as defined in the claims.

What is claimed is:

1. A photothermographic element comprising a substrate coated with a photothermographic composition comprising:
   (a) a photosensitive silver halide;
   (b) a non-photosensitive, reducible source of silver;
   (c) a reducing agent for said non-photosensitive, reducible source of silver;
   (d) a binder; and
   (e) a fluorinated polymer consisting essentially of at least three different groups within the polymer chain derived from reactive monomers, the monomers consisting essentially of:
      (i) a fluorinated, ethylenically unsaturated monomer;
      (ii) a hydroxyl-containing, ethylenically unsaturated monomer; and
      (iii) a polar, ethylenically unsaturated monomer.

2. The photothermographic element according to claim 1 wherein said silver halide is silver bromide, silver chloride, or silver iodide or mixtures thereof.

3. The photothermographic element according to claim 1 wherein said non-photosensitive, reducible source of silver is a silver salt of an aliphatic carboxylic acid having 1 to 30 carbon atoms.

4. The photothermographic element according to claim 1 wherein said reducing agent is a compound capable of being oxidized to form or release a dye.

5. The photothermographic element according to claim 4 wherein said compound capable of being oxidized to form or release a dye is a leuco dye.

6. The photothermographic element according to claim 1 wherein said binder is hydrophilic.

7. The photothermographic element according to claim 1 wherein said binder is hydrophobic.

8. The photothermographic element according to claim 1 wherein said fluorinated polymer has a weight average molecular weight in the range of about 2,000 to 20,000.

9. The photothermographic element according to claim 8 wherein said fluorinated polymer has a weight average molecular weight in the range of about 2,000 to 7,000.

10. The photothermographic element according to claim 1 wherein said fluorinated polymer is the acrylic reaction product of at least one fluorinated, ethylenically unsaturated monomer; at least one hydroxyl-containing, ethylenically unsaturated monomer; and at least one polar, ethylenically unsaturated monomer.

11. A thermographic element comprising a substrate coated with a thermographic composition comprising:
   (a) a non-photosensitive, reducible source of silver;
   (b) a reducing agent for said non-photosensitive, reducible source of silver;
   (c) a binder; and
   (d) a fluorinated polymer consisting essentially of at least three different groups within the polymer chain derived from reactive monomers, the monomers consisting essentially of:
      (i) a fluorinated, ethylenically unsaturated monomer;
      (ii) a hydroxyl-containing, ethylenically unsaturated monomer; and
      (iii) a polar, ethylenically unsaturated monomer.

12. A thermographic element according to claim 11 wherein said non-photosensitive, reducible source of silver is a silver salt of an aliphatic carboxylic acid having 1 to 30 carbon atoms.

13. The thermographic element according to claim 11 wherein said reducing agent is a compound capable of being oxidized to form or release a dye.

14. The thermographic element according to claim 13 wherein said reducing agent capable of being oxidized to form or release a dye is a leuco dye.

15. The thermographic element according to claim 11 wherein said binder is hydrophilic.

16. The thermographic element according to claim 11 wherein said binder is hydrophobic.

17. The thermographic element according to claim 11 wherein said fluorinated polymer has a weight average molecular weight in the range of about 2,000 to 20,000.

18. The thermographic element according to claim 11 wherein said fluorinated polymer has a weight average molecular weight in the range of about 2,800 to 7,000.

19. The thermographic element according to claim 11 wherein said fluorinated polymer is the acrylic reaction product of at least one fluorinated, ethylenically unsaturated monomer; at least one hydroxyl-containing, ethylenically unsaturated monomer; and at least one polar, ethylenically unsaturated monomer.

* * * * *